US007148419B1

(12) United States Patent
Harrigan

(10) Patent No.: US 7,148,419 B1
(45) Date of Patent: Dec. 12, 2006

(54) PRE-WIRED ELECTRICAL RECEPTACLE

(76) Inventor: Charles Harrigan, P.O. Box 230888, Anchorage, AK (US) 99523

( * ) Notice: Subject to any disclaimer, the term of this patent is extended or adjusted under 35 U.S.C. 154(b) by 0 days.

(21) Appl. No.: 11/090,784

(22) Filed: Mar. 24, 2005

(51) Int. Cl.
*H01H 9/02* (2006.01)

(52) U.S. Cl. ..... 174/53; 439/106; 439/652; 174/59

(58) Field of Classification Search ..... 174/53, 174/59; 439/535, 106, 107, 652, 108, 122, 439/650, 500
See application file for complete search history.

(56) References Cited

U.S. PATENT DOCUMENTS 5,460,542 A * 10/1995 Castellani et al. ..... 439/535
5,486,650 A * 1/1996 Yetter ..... 174/53
6,923,675 B1 * 8/2005 Gorin ..... 439/491

* cited by examiner

*Primary Examiner*—Dhiru R. Patel
(74) *Attorney, Agent, or Firm*—Michael Tavella

(57) ABSTRACT

A receptacle that is internally hard wired. The body of the receptacle is sealed, except for three outlets, through which pass precut "pigtail" wires. One wire is the "hot" wire, one is the "neutral" and one is the ground. To install this receptacle, an electrician has to remove the end cover from the pigtails and then simply connect them to the circuit wires in the box using common wire connectors such as WIRE NUTS. There is no need to tighten screws or to wrap the receptacle body with tape. The unit is sealed and completely protected. The electrician simply has to push the wires into the box and secure the receptacle with the mounting screws. For circuits that are daisy chained, the electrician simply connects all of the wires together (i.e., al "hot" wires together with one connector, all "neutrals" with another connector, and so on.

9 Claims, 6 Drawing Sheets

PRE-WIRED ELECTRICAL RECEPTACLE

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to electrical receptacles and particularly to pre-wired electrical receptacles.

2. Description of the Prior Art

Electrical receptacles have been used for years in homes, offices and industrial locations to deliver electricity to various equipment and appliances. Over the years, the design of the receptacle has become standardized. Essentially, it is an ovular device that has an insulated face that projects forward from an electrical box. The face typically provides two outlets that can be used to plug in appliances, or other equipment.

Receptacles are wired in a building's electrical circuits. Typically, receptacles have two pairs of screws attached to the sides of the receptacle. One pair is used to connect the "hot" leg and the other pair connects the neutral wire. The two pairs of screws allow receptacles to be daisy-chained together. In this way, many receptacles can be connected to one circuit. Moreover, the screws connect to a metal buss that can be divided into two distinct zones. This allows the electrician to wire the top outlet on one circuit and the bottom outlet on a separate circuit. For example, it allows one outlet to be fed by a switch so that it can be energized remotely, while the other outlet can be continuously energized.

Modern receptacles also have gripping teeth that allow a worker to insert a stripped wire into the back of the receptacle. In this way, wiring can be done faster. It has been noted, however, that the gripping teeth on the receptacles do not always hold and can loosen the connection overtime (due to repeated heating and cooling cycles of the wiring). As a result, most professionals do not use the gripping teeth in wiring receptacles. This means that the wires must be stripped and bent to fit under the screws, the screws must be tightened and then, typically, a piece of electrical tape is placed around the sides of the receptacle to reduce the hazard of electrical shock due to the exposed electrical parts.

Considering that even a relatively small house can have 30 individual receptacles—and business can have hundreds, the wiring process takes a significant amount of time. Moreover, it requires some skill to ensure that the wires are attached properly to the screws and they are properly tightened.

Several attempts have been made to make this process simpler. U.S. patents show specially designed boxes that are simple to wire. Specially made receptacles are then plugged into the pre-wired busses in these boxes. These devices eliminate the need for the time-consuming wiring of each receptacle. However, they have several drawbacks. First, their use would require a complete shift in modern wiring techniques. Boxes would have to be replaced and wired, new receptacles have to be obtained, and workers would have to be retrained in their use. Moreover, the cost of such equipment may be considerably higher than the equipment presently available.

FIGS. 1 and 2 show the prior art receptacle. FIG. 1 is a top view of a typical duplex type receptacle 100. The receptacle has a body 102, mounting ears 103 and mounting screws 104. In most cases, wiring of the receptacle is one by wrapping the skinned wire over the attachment screws 105. In most cases, two sets of screws 105 are provided. On one side of the receptacle, the "hot" wire is attached. On the other side, the "neutral" wire is connected. A ground wire is attached to screw 106 as well. If the circuit is daisy chained, an additional pair of wires is attached to the second set of screws 105. Otherwise, these screws must be tightened down. Once the wiring is complete, an electrician often wraps the body of the receptacle with electrical tape, to cover the screws and metal parts of the receptacle. This is done to prevent inadvertent contact with the "hot" metal parts of the receptacle. This process takes a considerable amount of time. When multiplied by the 50 or more receptacles in a modern house, or the hundreds of receptacles in a large building, the time spent on wiring receptacles is considerable.

Moreover, the task must be done correctly or else problems might ensue ranging from badly operating circuits to fires.

BRIEF DESCRIPTION OF THE INVENTION

The instant invention overcomes these problems. It is a receptacle that is internally hard wired. The body of the receptacle is sealed, except for three outlets, through which pass precut "pigtail" wires. One wire is the "hot" wire, one is the "neutral" and one is the ground. To install this receptacle, an electrician has to remove the end cover from the pigtails and then simply connect them to the circuit wires in the box using common wire connectors such as WIRE NUTS. There is no need to tighten screws or to wrap the receptacle body with tape. The unit is sealed and completely protected. The electrician simply has to push the wires into the box and secure the receptacle with the mounting screws. For circuits that are daisy chained, the electrician simply connects all of the wires together (i.e., al "hot" wires together with one connector, all "neutrals" with another connector, and so on.

In this way, the installation of receptacles can be done quickly, easily and correctly in a minimum of time.

DETAILED DESCRIPTION OF THE INVENTION

Figure 1:
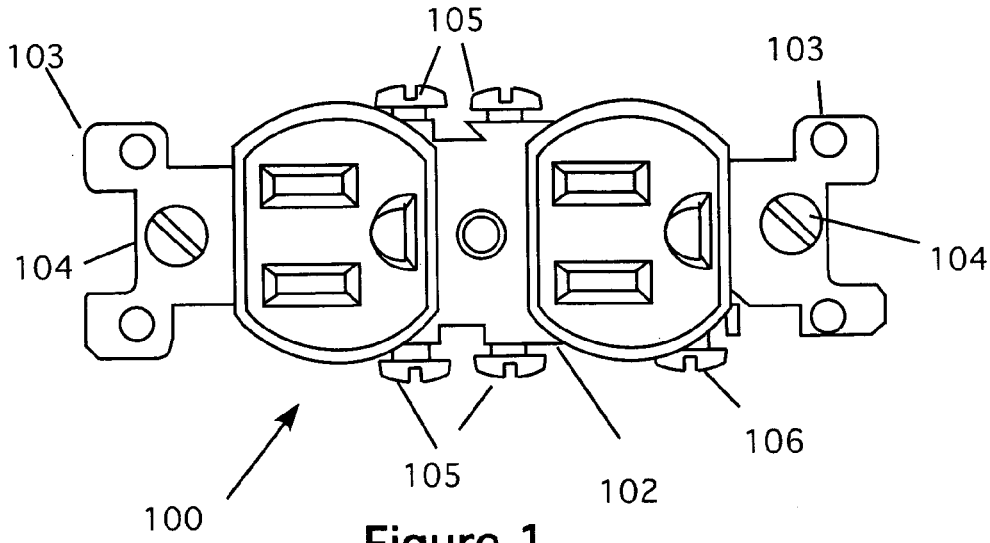
Figure 1 Prior Art
FIG. 1 is a top view of a duplex receptacle as prior art.
Figure 2:
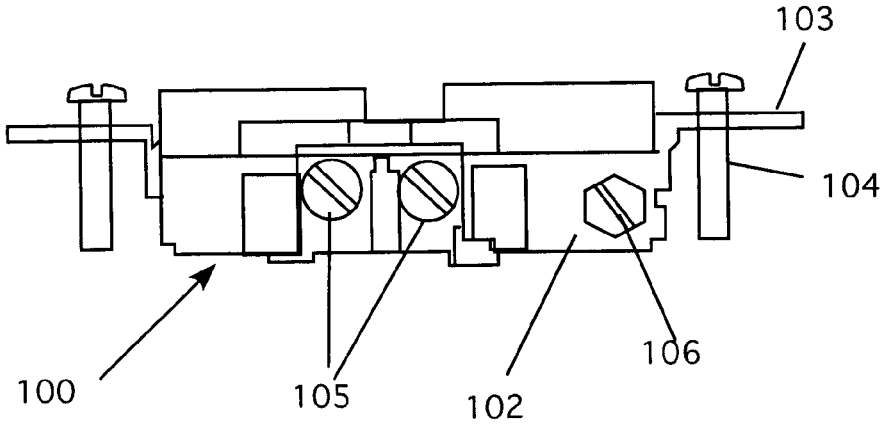
Figure2 Prior Art
FIG. 2 is a side view of a duplex receptacle as prior art.
Figure 3:
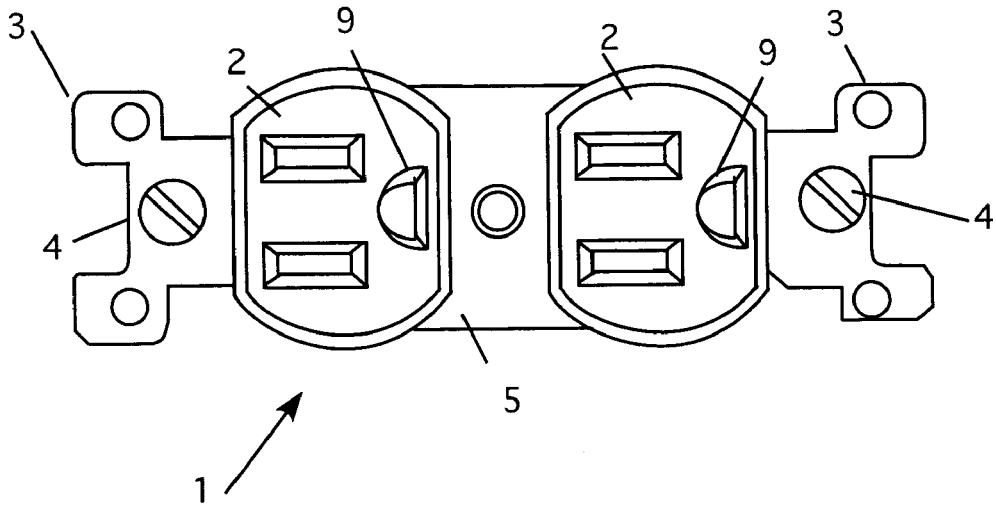
FIG. 3 is a top view of the instant invention.
Figure 4:
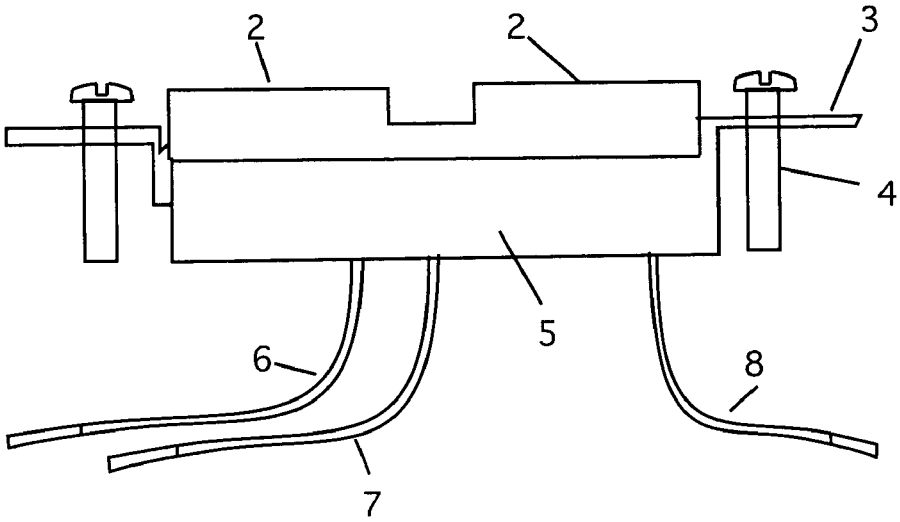
FIG. 4 is a side view of the instant invention.
Figure 5:
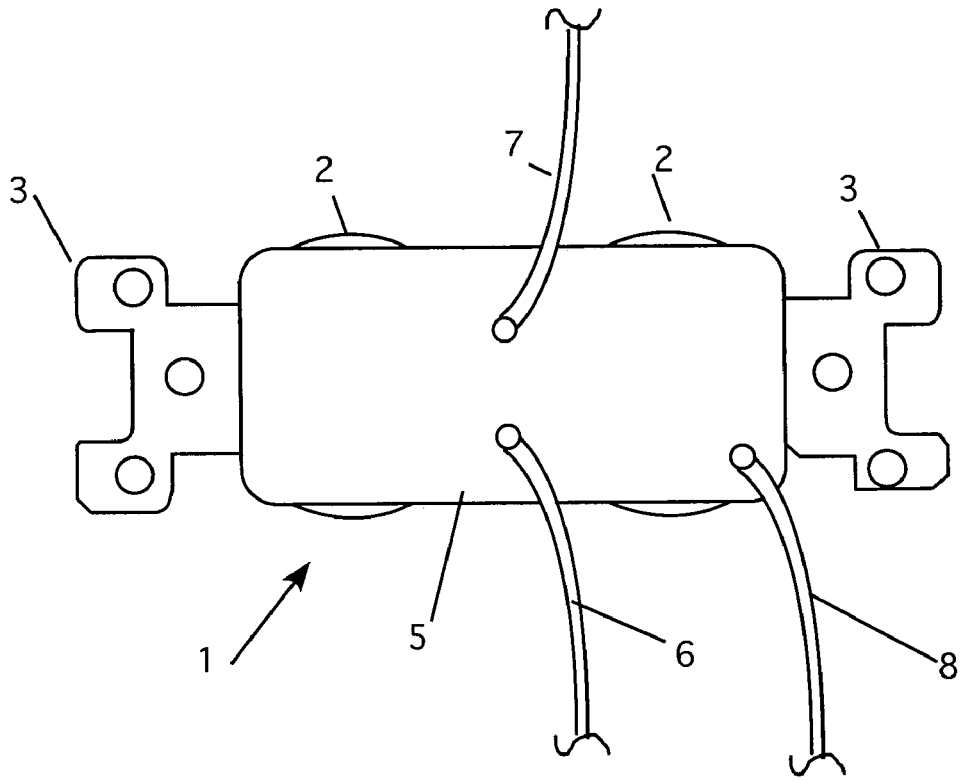
FIG. 5 is a bottom view of the instant invention.

Referring now to FIGS. 3–5, the instant invention is shown. FIG. 3 is a top view of the instant invention. FIG. 4 is a side view of the instant invention. These views can be compared to the views of FIGS. 1 and 2 showing the prior art to show the differences between them.

In FIGS. 3 and 4, the biggest difference is the lack of screws and other exposed metal parts. In FIGS. 3 and 4, the receptacle 1 has two outlets 2 as before that have a grounding portion 9. There are two mounting ears 3 and two mounting screws 4 as before. However, the body 5 is solid insulating material (such as plastic). There are no external screws or other parts used for connections. FIG. 4 shows two power wires 6 and 7 and one grounding wire 8. FIG. 5 shows the bottom view of the invention. Here, the body 5 is shown sealed with only three openings for wires to pass through. The wires 6, 7 and 8 pass through the bottom as shown. The wires are connected internally using techniques ordinary to the art.

Figure 6:
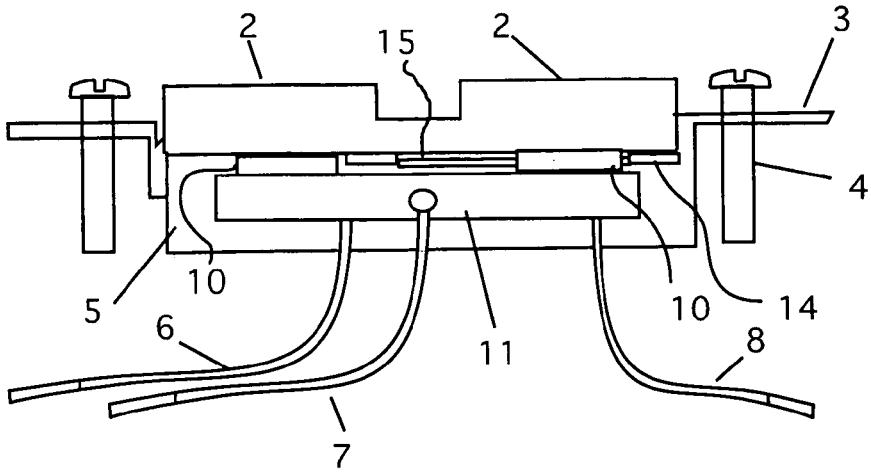
FIG. 6 is a side cutaway view of the instant invention.
Figure 7:
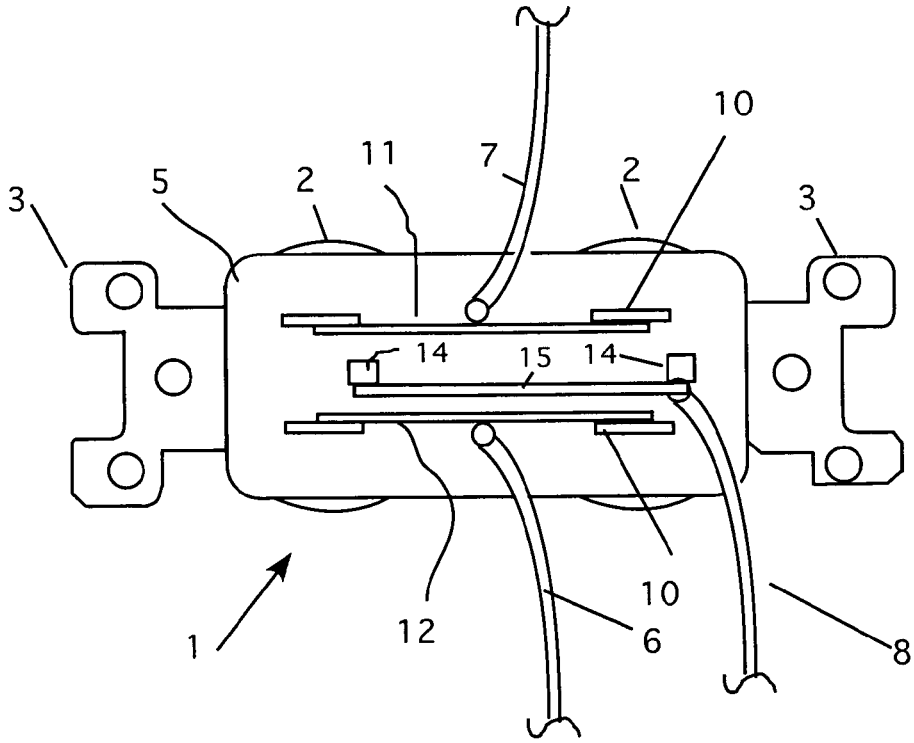
FIG. 7 is a bottom cutaway view of the instant invention.

FIG. 6 is a side cutaway view of the instant invention. FIG. 7 is a bottom cutaway view of the instant invention. In these views, internal components are shown. The figure shows representative components. Of course, other components and configurations can be used using the same techniques discussed herein. FIG. 6 shows the two outlets 2. Each of the outlets 2 has a pair of blades 10 (see also, FIG. 7). The blades 10 extend down and attach to two busses 11 and 12, one "hot" and the other "neutral". The ground connections have a pair of connectors 14 that attach to a ground buss 15. The leads 6, 7 and 8 are attached to the busses a shown in FIGS. 6 and 7 using common techniques, such as crimping, soldering, etc.

In this way, the hard-wired leads exit the housing where they can be connected to the supply wires using common wiring techniques without having to make connections to the receptacle.

Figure 8:
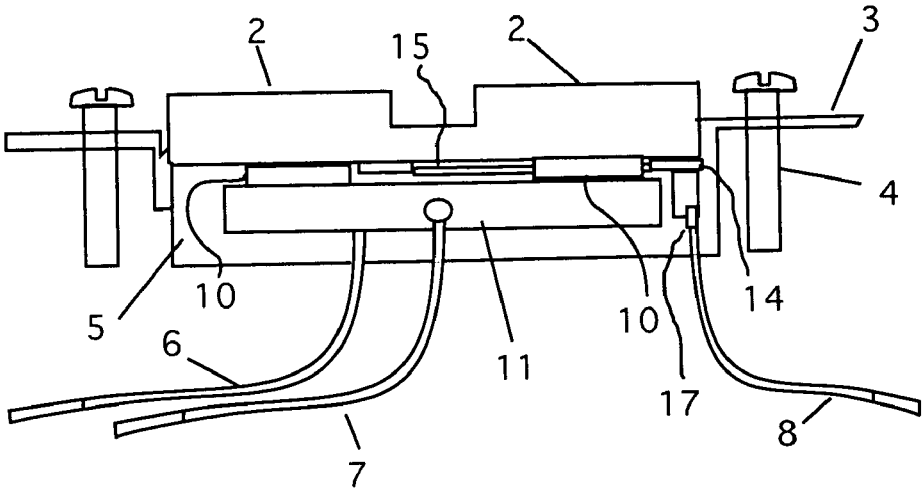
FIG. 8 is a side cutaway view of the instant invention showing an alternative-grounding scheme.

FIG. 8 is a side cutaway view of the instant invention showing an alternative-grounding scheme. This scheme is not preferred. In this scheme, the ground buss 15 extends to the side of the outlet housing 5 where it penetrates the housing and forms a stud type connection 17. The ground lead is then crimped to this stud in the manufacture of the receptacle.

Figure 9:
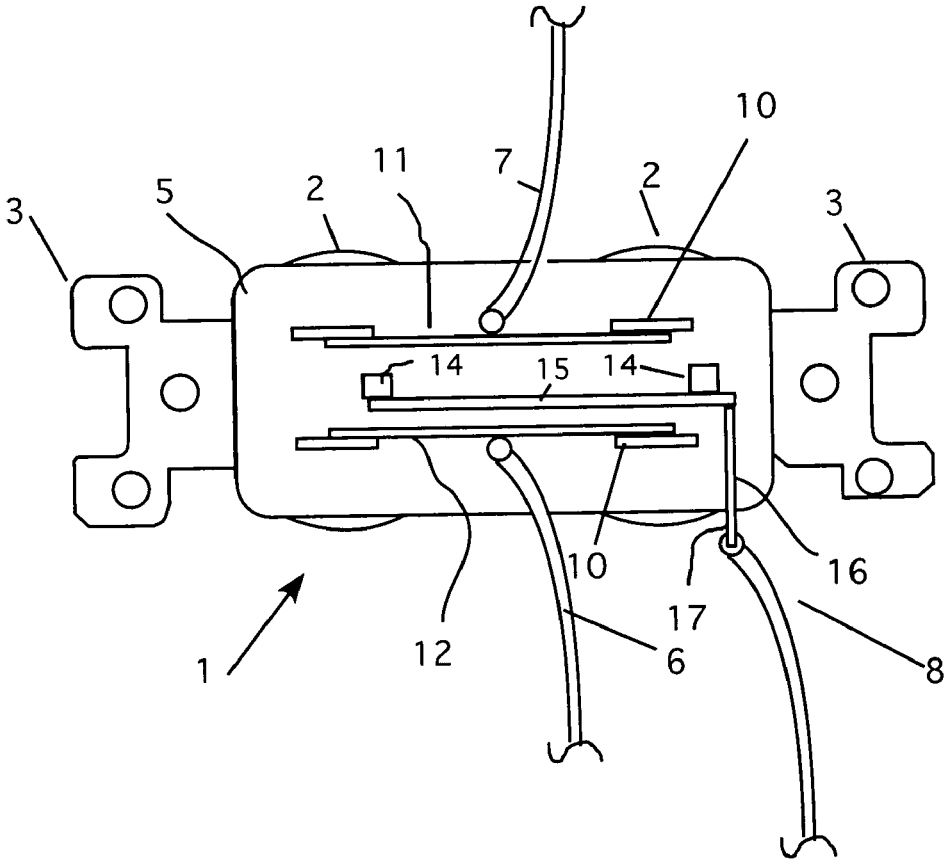
FIG. 9 is a bottom cutaway view of the instant invention showing an alternative-grounding scheme.

FIG. 9 is a bottom cutaway view of the instant invention showing an alternative-grounding scheme. This figure shows the extension 16 of the buss 15 and the stud 17. Once the ground lead is crimped to the stud 17 the lead can be connected t to the supply ground as before.

Either embodiment of the receptacle is used by simply removing the insulation at the ends of the wires, and then connecting them to the circuit wires using standard connectors.

Figure 10:
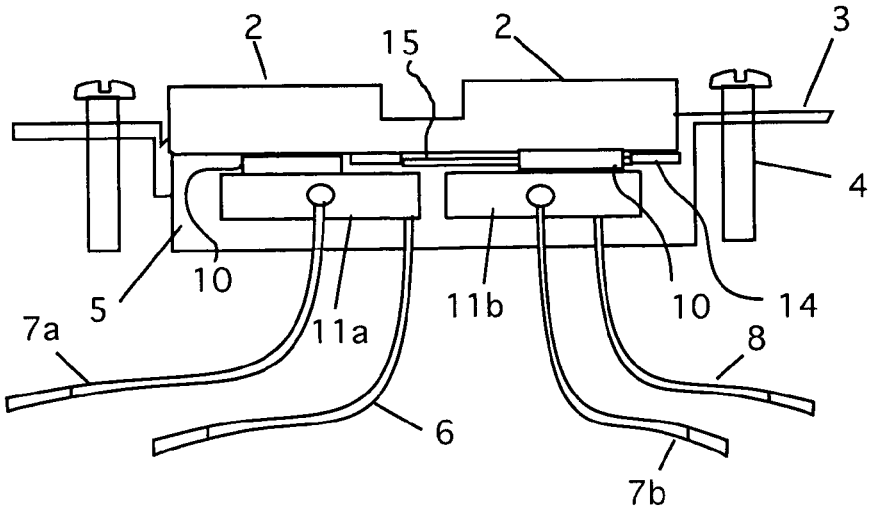
FIG. 10 is a side cutaway view showing a split buss configuration for a switched receptacle.
Figure 11:
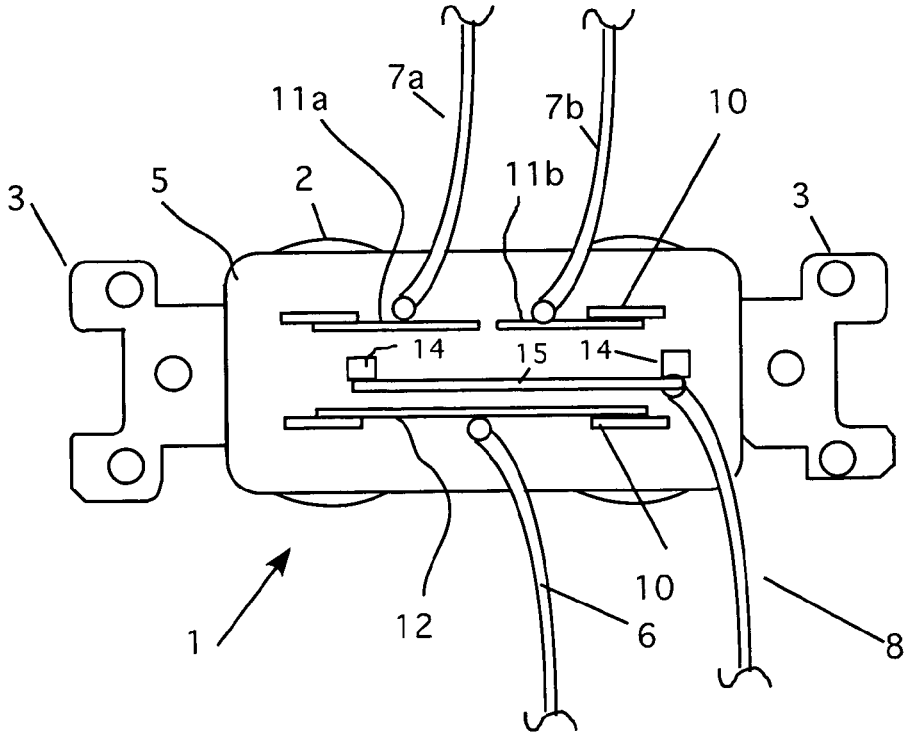
FIG. 11 is a bottom cutaway view showing a split buss configuration for a switched receptacle.

Note that these receptacles cannot be used in cases where one of the two outlets on the receptacle is intended as a switched outlet. In these receptacles, the two outlets are solidly connected. In the case of switched outlets, an alternative embodiment can be used. This embodiment is shown in FIGS. 10 and 11. FIG. 10 is a side cutaway view showing a split buss configuration for a switched receptacle. Here, the buss 11 of the previous embodiment is split into two parts, 11*a* and 11*b*. Note that this only applies to the hot leg side of the receptacle. The neutral and ground busses are not affected. FIG. 10 shows a lead 7*a* connecting to buss 11*a* and a lead 7*b* connecting to buss 11*b*. In all other aspects, the receptacle is the same. FIG. 11 is a bottom cutaway view showing a split buss configuration for a switched receptacle. Here, the two hot busses, 11*a* and 11*b* are shown. This view also shows that the neutral buss 12 and grounding buss 15 remain the same. In installing this receptacle, the circuit wiring uses a three-wire circuit plus ground. One half of the receptacle is connected to the main power source as usual e.g., lead 7*a* is attached to the main power. Lead 7*b*, however, is connected to a wire coming from a switch. The switch then controls power to the second hot buss (11*b*). This compares to the prior art practice of breaking a jumper connecting the two screw plates on the receptacle and then connecting the leads to separate screws. Typically, a black wire is used for the main power lead and a red wire is used for the switch leg. The leads coming from the receptacle can be like wired, making installation extremely simple.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A pre-wired electrical receptacle comprising:

a) a receptacle body having at least one electrical outlet, having an interior;

b) a pair of blades, contained entirely within said receptacle body, connected to said outlet, said pair of blades forming a hot side and a neutral side;

e) a hot lead, fixedly and permanently attached to said hot side and extending out of said receptacle body; and f) a neutral lead, fixedly and permanently attached to said neutral side and extending out of said receptacle body; and g) further wherein said receptacle body is sealed such that the interior of said receptacle body is inaccessible to a user.

2. The pre-wired electrical receptacle of claim 1 further comprising:

a) a grounding portion formed in said at least one electrical outlet;

b) a grounding connector, contained entirely within said receptacle body, and being connected to said grounding portion;

c) a grounding lead, attached to said grounding connector and extending out of said receptacle body.

3. A pre-wired electrical receptacle comprising:

a) a receptacle body having a pair of electrical outlets, and an interior;

b) a first pair of blades, contained entirely within said receptacle body, and being connected to one of said pair of outlets, said pair of blades having a hot side and a neutral side;

c) a second pair of blades, contained entirely within said receptacle body, and connected to the other of said pair of outlets, said pair of blades having a hot side and a neutral side;

d) a hot buss, installed in said receptacle body and being fixedly attached to said hot side of said first and second pair of blades;

e) a neutral buss, installed in said housing and being fixedly attached to said neutral side of said first and second pair of blades;

f) a hot lead, fixedly and permanently attached to said hot buss and extending out of said receptacle body; and g) a neutral lead, fixedly and permanently attached to said neutral buss and extending out of said receptacle body; and h) further wherein said receptacle body is sealed such that the interior of said receptacle body is inaccessible to a user.

4. The pre-wired electrical receptacle of claim 3 further comprising:

a) a grounding portion formed in each of said pair of electrical outlets;

b) a grounding connector, contained entirely within said receptacle body, and being connected to each of said pair of outlets at said grounding portion;

c) a grounding buss, attached to each of said grounding connectors; and d) a grounding lead, attached to said grounding connector and extending out of said receptacle body.

5. The pre-wired electrical receptacle of claim 3 further comprising:

a) a grounding portion formed in each of said pair of electrical outlets;

b) a grounding connector, contained entirely within said receptacle body, connected to each of said pair of outlets at said grounding portion;

c) a grounding buss, attached to each of said grounding connectors, said grounding buss extending out of said receptacle body, forming a grounding stud; and d) a grounding lead, attached to said grounding stud on the outside of said receptacle body said receptacle body.

6. A pre-wired electrical receptacle comprising:

a) a receptacle body having a pair of electrical outlets and an interior;

b) a first pair of blades, contained entirely within said receptacle body, and being connected to one of said pair of outlets, said pair of blades having a hot side and a neutral side;

c) a second pair of blades, contained entirely within said receptacle body, and connected to the other of said pair of outlets, said pair of blades having a hot side and a neutral side;

d) a first hot buss, installed in said receptacle body and being fixedly attached to said hot side of said first pair of blades;

e) a second hot buss, installed in said receptacle body and being fixedly attached to said hot side of said second pair of blades;

f) a neutral buss, installed in said housing and being fixedly attached to said neutral side of said first and second pair of blades;

g) a first hot lead, fixedly and permanently attached to said first hot buss and extending out of said receptacle body;

h) a second hot lead, fixedly and permanently attached to said second hot buss and extending out of said receptacle body;

i) a neutral lead, fixedly and permanently attached to said neutral buss and extending out of said receptacle body; and j) further wherein said receptacle body is sealed such that the interior of said receptacle body is inaccessible to a user.

7. The pre-wired electrical receptacle of claim 6 further comprising:

a) a grounding portion formed in each of said pair of electrical outlets;

b) a grounding connector, contained entirely within said receptacle body, connected to each of said pair of outlets at said grounding portion;

c) a grounding buss, attached to each of said grounding connectors; and d) a grounding lead, attached to said grounding connector and extending out of said receptacle body.

8. The pre-wired electrical receptacle of claim 6 wherein the first hot lead and the second hot lead have separate indicator markings.

9. The pre-wired electrical receptacle of claim 8 wherein the separate indicator markings comprise a first color applied to said first hot lead, and a second color applied to said second hot lead.

* * * * *